US005353015A

United States Patent [19]

Robinson

[11] Patent Number: 5,353,015

[45] Date of Patent: Oct. 4, 1994

[54] TAMPER DETECTOR

[75] Inventor: Wesley A. Robinson, San Bernardino, Calif.

[73] Assignee: The United States of America as represented by the Secretary of the Air Force, Washington, D.C.

[21] Appl. No.: 877,954

[22] Filed: Apr. 23, 1992

[51] Int. Cl.[5] ..... G08B 21/00; H01F 7/00

[52] U.S. Cl. ..... 340/686; 335/229; 340/547; 361/147

[58] Field of Search ..... 340/551, 547, 568, 686; 361/147, 179; 307/116; 324/207.22, 207.26; 335/229–230

[56] References Cited

U.S. PATENT DOCUMENTS

| | | | |
|---|---|---|---|
| 2,901,676 | 8/1959 | Mittag | 361/179 X |
| 3,450,955 | 6/1969 | Johnson | 361/147 X |
| 3,458,769 | 7/1969 | Stampfli | 361/147 |
| 3,599,187 | 8/1971 | Bobeck et al. | 365/138 |
| 4,321,570 | 3/1982 | Tsunefuji | 335/229 |
| 4,438,430 | 3/1984 | Young et al. | 340/547 |
| 4,903,578 | 2/1990 | Terp | 335/229 X |
| 4,905,031 | 2/1990 | Mody | 361/147 X |
| 4,910,634 | 3/1990 | Pipkorn | 361/147 |
| 4,945,340 | 7/1990 | Brill | 340/547 |
| 5,111,092 | 5/1992 | Reinicke | 340/551 X |

*Primary Examiner*—Thomas Mullen

*Attorney, Agent, or Firm*—Donald J. Singer; Robert L. Nathans

[57] ABSTRACT

The unauthorized separation of a second member such as a door with respect to a first member affixed to a computer frame and the subsequent replacement of the initial position of the door creates a change of state of a square loop magnetic member integral with the computer frame. This change of state can be monitored from time to time to indicate an unauthorized opening of the door.

10 Claims, 1 Drawing Sheet

TAMPER DETECTOR

BACKGROUND OF THE INVENTION

The present invention relates to the field of security devices and more particularly those capable of detecting prior tampering.

In certain environments it is desirable to know whether there has been an unauthorized removal of one component relative to another component. For example, if a removable unit in data processor equipment has been removed and replaced by another unit, there could be a change in the unit or data stored therein which could cause a security breach or otherwise compromise the integrity of the processor. It may also be desirable to know if an access door to a security alarm system of a computer or another portion of the computer, or for that matter any other protected area, has been opened by an unauthorized individual, in order to indicate a compromise in security. Prior art locks used to prevent such tampering can be picked without detection and seals can be replaced without visual detection, if the intruder is sufficiently clever.

BRIEF SUMMARY OF THE INVENTION

In accordance with a preferred embodiment of the invention, a tamper detector detects prior separation of a first member coupled to a protected area of a computer for example, relative to a removable second member which could be connected to an access door of the computer. Upon unauthorized opening of the door, the magnetization direction (MD) of a magnetic square loop material in the first member is switched from a first state to a second state and when the door is thereafter closed, the loop material remains in the second state. The state of the loop material is thereafter detected, and if it is in the second state, this indicates that the door was previously opened. An authorized opening of the door could energize a reset winding to switch the MD of the square loop material back to the first state.

BRIEF DESCRIPTION OF THE DRAWINGS

Other objects, features and advantages of the present invention will become apparent from study of the following detailed description taken in conjunction with the drawings in which.

DETAILED DESCRIPTION OF A PREFERRED EMBODIMENT OF THE INVENTION

Figure 1:
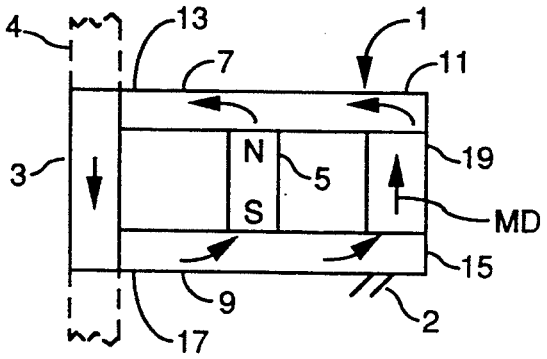
FIG. 1 illustrates the detector in the first state.

The aforesaid first member 1 is in contact with second member 3 which could be coupled to the door 4 of the computer. A first elongated soft magnetic member or flux conductor 7 contacts the north pole of permanent magnet 5 while a like second elongated member or flux conductor 9 contacts the opposite south pole of the permanent magnet 5 as shown. First terminal portions 11 and 15 of the first and second elongated members straddle a square loop magnetic member 19 as shown while the second terminal portions 13 and 17 of the elongated members are in contact with the second member 3. Recall that the second movable soft magnetic member contacts the first member when the door is closed. The first member is affixed to mechanical ground 2 within the computer compartment.

Figure 2:
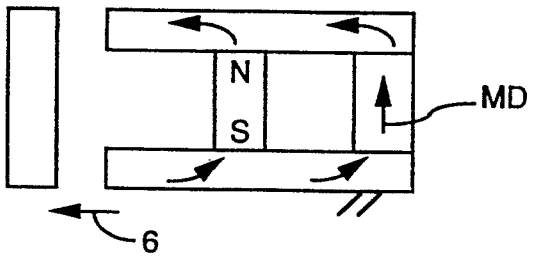
FIG. 2 illustrates the unstable state produced by separation of the first and second members.
Figure 3:
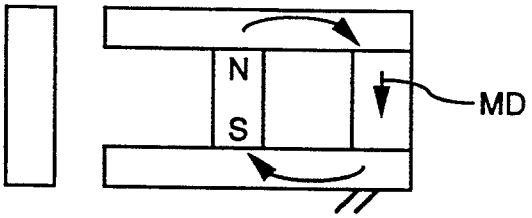
FIG. 3 illustrates the final second state after separation.

The initial first state of the square loop member 19 is shown in FIG. 1, where arrow MD points up. When the door is opened, as indicated by arrow 6, the second member 3 is separated from the first member and the flux lines assume the orientation as shown in FIG. 2. This highly unstable state immediately reverts to the second stable state where the square loop material assumes the second magnetization state indicated by the downward pointing arrow MD shown in FIG. 3.

Figure 4:
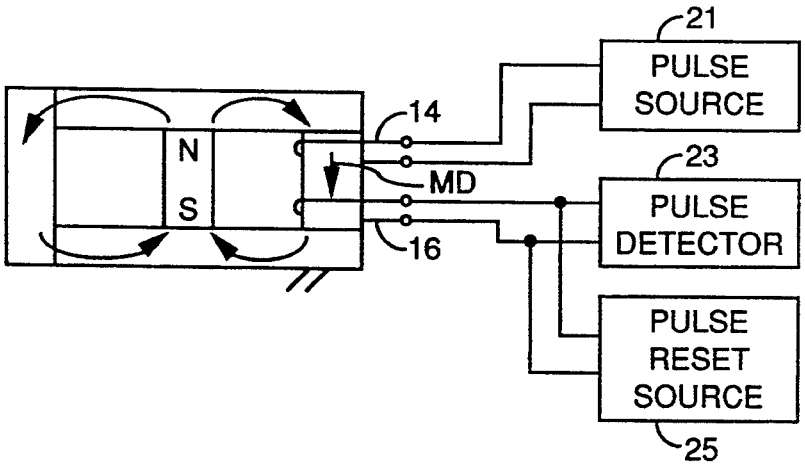
FIG. 4 illustrates the flux distribution after the second member again contacts the first member.

When the door is now closed, the second member 3 again contacts the first member as shown in FIG. 4. However the square loop magnetization direction remains in the second state which indicates tampering by an unauthorized person. This second state can be detected in a number of ways. One way could be by passing a pulse produced by source 21 through read winding 14 having a polarity which would switch the state of 19 from the second state (MD points down) back to the first state where the M arrow points up. If the second state is present, the resulting flux reversal would produce an output pulse in winding 16, detected by pulse detector 23, which indicates tampering. If there is no tampering, no output pulse would be produced in winding 16 since the flux was in the first state upon interrogation by winding 14 and hence would not be switched.

Thus, windings 14 and 16 and pulse circuitry not shown, comprise detector means for detecting the state of magnetization of the square loop member 19. The device could be initialized or reset to the first state by having reset pulse source 25 applied a pulse to pulsing winding 16 to switch the state from the second to the first if the device is in the second state. This would be accomplished upon each authorized opening of the door. A subsequent unauthorized door opening would switch the device to the second state which could immediately produce an alarm pulse in the windings if desired, rather than periodically detecting the state as indicated above. Of course if the door opening is authorized, the alarm pulse would be repressed or ignored.

While there has been described what is at present considered to be the preferred embodiments of this invention, it will be obvious to those skilled in the art that various changes and modifications may be made therein without departing from the invention and it is, therefore, intended in the appended claims to cover all such changes and modifications as fall within the true spirit and scope of the invention, including art recognized equivalents.

What is claimed is:

1. A tamper indicator for indicating to monitoring personnel that separation of a first member and a second member which is in contact with said first member upon inspection thereof by said monitoring personnel has occurred prior to said inspection, wherein said first member comprises:

(a) a permanent magnet having a first pole and a second pole of a polarity opposite said first pole;

(b) a first elongated soft magnetic flux conductor magnetically coupled to the first pole of said permanent magnet and having a first terminal portion and a second terminal portion;

(c) a second elongated soft magnetic flux conductor magnetically coupled to the second pole of said permanent magnet and having a first terminal portion and a second terminal portion; and (d) a square loop magnetic member magnetically coupled between the first terminal portion of said first elongated soft magnetic flux conductor and the first terminal portion of said second elongated soft magnetic flux conductor; and wherein said second member is made of a soft magnetic material for conducting flux between the second terminal portions of said first and second elongated soft magnetic flux conductors; and said tamper indicator further including detector means coupled to said square loop magnetic member for detecting the state of magnetization thereof.

2. The tamper indicator of claim 1 further including reset means for reversing the state of magnetization of said square loop magnetic member.

3. The tamper indicator of claim 2 wherein said second member is coupled to a door.

4. The tamper indicator of claim 1 wherein said second member is coupled to a door.

5. A tamper indicator for indicating to monitoring personnel that separation of a first member and a second member which is in contact with said first member upon inspection thereof by said monitoring personnel has occurred prior to said inspection, wherein said first member comprises:

(a) a permanent magnet having a first pole and a second pole of a polarity opposite said first pole;

(b) a first soft magnetic flux conductor magnetically coupled to the first pole of said permanent magnet and having a first portion and a second portion;

(c) a second soft magnetic flux conductor magnetically coupled to the second pole of said permanent magnet and having a first portion and a second portion; and (d) a square loop magnetic member magnetically coupled between the first portion of said first soft magnetic flux conductor and the first portion of said second magnetic flux conductor; and wherein said second member is made of a soft magnetic material for conducting flux between the second portions of said first and second soft magnetic flux conductors; and said tamper indicator further including detector means coupled to said square loop magnetic member for detecting the state of magnetization thereof.

6. The tamper indicator of claim 5 further including reset means for reversing the state of magnetization of said square loop magnetic member.

7. The tamper indicator of claim 6 wherein said second member is coupled to a door.

8. The tamper indicator of claim 5 wherein said second member is coupled to a door.

9. A tamper indicator for indicating to monitoring personnel that separation of a first member and a second member which is in contact with said first member upon inspection thereof by said monitoring personnel has occurred prior to said inspection, wherein said first member comprises:

(a) a permanent magnet having a first pole and a second pole of a polarity opposite said first pole;

(b) a first elongated soft magnetic flux conductor magnetically coupled to the first pole of said permanent magnet and having a first terminal portion and a second terminal portion;

(c) a second elongated soft magnetic flux conductor magnetically coupled to the second pole of said permanent magnet and having a first terminal portion and a second terminal portion; and (d) a square loop magnetic member magnetically coupled between the first terminal portion of said first elongated soft magnetic flux conductor and the first terminal portion of said second elongated soft magnetic flux conductor; and wherein said second member is made of a soft magnetic material for conducting flux between the second terminal portions of said first and second elongated soft magnetic flux conductors;

and wherein said second member is coupled to a door.

10. A tamper indicator for indicating to monitoring personnel that separation of a first member and a second member which is in contact with said first member upon inspection thereof by said monitoring personnel has occurred prior to said inspection, wherein said first member comprises:

(a) a permanent magnet having a first pole and a second pole of a polarity opposite said first pole;

(b) a first soft magnetic flux conductor magnetically coupled to the first pole of said permanent magnet and having a first portion and a second portion;

(c) a second soft magnetic flux conductor magnetically coupled to the second pole of said permanent magnet and having a first portion and a second portion; and (d) a square loop magnetic member magnetically coupled between the first portion of said first soft magnetic flux conductor and the first portion of said second magnetic flux conductor; and wherein said second member is made of a soft magnetic material for conducting flux between the second portions of said first and second soft magnetic flux conductors;

and wherein said second member is coupled to a door.

* * * * *